US006558014B2

(12) United States Patent
Just et al.

(10) Patent No.: US 6,558,014 B2
(45) Date of Patent: May 6, 2003

(54) ILLUSTRATION ILLUMINATOR

(75) Inventors: Christa Just, Weilheim/Teck (DE); Michael Gall, Salach (DE)

(73) Assignee: Just Normlicht Vertriebs-GmbH, Weilheim/Teck (DE)

( * ) Notice: Subject to any disclaimer, the term of this patent is extended or adjusted under 35 U.S.C. 154(b) by 0 days.

(21) Appl. No.: 09/855,685

(22) Filed: May 15, 2001

(65) Prior Publication Data

US 2002/0021570 A1 Feb. 21, 2002

(30) Foreign Application Priority Data

May 18, 2000 (DE) ..... 100 24 094

(51) Int. Cl.[7] ..... F21V 13/00

(52) U.S. Cl. ..... 362/33; 362/37; 362/38; 362/39; 362/98; 362/235; 362/414; 40/559

(58) Field of Search ..... 362/33, 37, 38, 362/39, 431, 414, 235, 247, 249, 248, 153, 296, 343, 347, 98; 40/559

(56) References Cited

U.S. PATENT DOCUMENTS 2,472,624 A * 6/1949 Schwartz
4,517,631 A * 5/1985 Mullins ..... 362/346
4,748,543 A * 5/1988 Swarens ..... 362/147
5,016,153 A * 5/1991 Gixmondi et al. ..... 362/402
6,238,066 B1 * 5/2001 Iwasaki ..... 362/347

* cited by examiner

*Primary Examiner*—Sandra O'Shea
*Assistant Examiner*—Jacob Y. Choi
(74) *Attorney, Agent, or Firm*—Friedrich Kueffner

(57) ABSTRACT

An illustration illuminator has a leg arrangement and a frame connected to the leg arrangement and extending upwardly and at a slant rearwardly away from the leg arrangement. A support surface is arranged at the front side of the frame for supporting an illustration to be illuminated. A light assembly is connected to the frame remote from the leg arrangement for illuminating the support surface. The light assembly has lamps emitting light rays and further has a front end with an outlet via which the light rays exit and impinge on the support surface. The light assembly has a reflector arranged relative to the lamps such that the light rays emitted by the lamps pass through the outlet only after having been reflected at least once on the reflector.

8 Claims, 2 Drawing Sheets

ILLUSTRATION ILLUMINATOR

BACKGROUND OF THE INVENTION

1. Field of the Invention

The invention relates to an illustration illuminator comprising a leg, a frame projecting upwardly and slightly rearwardly therefrom, wherein the frame comprises a support surface on the front side of the frame, and a light assembly arranged above the frame and illuminating the support surface. Such an illuminator is employed in the graphic design industry in electronic image processing for the purpose of a standardized front illumination of an illustration in order to be able to perform color evaluations.

2. Description of the Related Art

Known illustration illuminators comprise a base member which projects, starting at a leg which can be placed onto a support area, in the upward direction and is slightly slanted to the rear. The illustration to be viewed is placed onto the front surface facing the operator. Starting at the base member, above it, an illumination unit is provided which is gallows-shaped and oriented toward the operator. The illustration placed onto the front surface of the base member is illuminated by light emitted by the lamp/lamps of the illumination unit. A disadvantage of this known solution is, in particular, that the illumination of the illustration is not absolutely glare-free and non-dazzling. This is referred to as a non-uniform illumination of the illustration.

SUMMARY OF THE INVENTION

It is an object of the present invention to provide an illustration illuminator with which the illustration to be viewed is illuminated significantly more uniformly in comparison to known devices, basically in a glare-free and non-dazzling way.

In accordance with the present invention, this is achieved in that the light assembly comprises a reflector with which the light rays emitted by the lamps pass through the light outlet only after being reflected at least once on the reflector and only then impinge onto the support surface.

The gist of the invention and the important feature in connection with the novel illustration illuminator resides in the light assembly and, in particular, its reflector which makes it possible that no direct light will be emitted by the lamps onto the illustration (specimen) so that the illustration to be viewed and arranged on the support surface is illuminated basically in a glare-free and non-dazzling way and with a uniformness which has been unattainable before.

The novel feature of the light assembly, i.e., its characteristic feature, is primarily that its lamps, at least one, are/is arranged substantially in or behind an imaginary frontal plane which is positioned behind the upper edge of the support surface receiving the illustration and not, as is the case in the prior art, in front of the illustration.

Moreover, it is important that the light assembly cover, provided at its inner surface with a reflective layer, begins at a base which supports the lamps and ends with its forward edge in a frontal plane which is positioned in front of the forward frontal plane of the support surface.

In particular, as a further feature of the configuration, it is provided that the light assembly cover has several successively arranged, and preferably seamlessly connected, sections, wherein the sections, in particular, neighboring sections, have curvatures of different magnitude. The section with the greatest curvature is arranged at the rearward end of the light assembly cover facing away from the viewer, while the significantly more weakly curved light assembly cover section, beginning at the latter, extends to the front edge of the light assembly cover.

Preferably, the curvature of the light assembly cover is selected such that, starting at the planar base, any location on the curved sections of the light assembly cover has a different radius of curvature. In the direction toward the front, i.e., toward the viewer, the lamps of the light assembly are shielded by a screen (screen plate or bar or rail).

The light rays emitted by the lamp or lamps of the light assembly, which are formed to bundles of rays by an inner aperture, which is formed by the upper edge of the screen rail or bar and the area of the strongly curved section of the light assembly cover positioned at a right angle thereto, are reflected at the respective reflective layer of the sections of the light assembly cover at least once, preferably several times.

Only after at least one reflection, preferably two to five reflections, the bundles of rays exit through an outlet or outer aperture, which delimits a ray channel directed toward the support surface, from the light assembly and impinge as directionally oriented, homogenous, indirect light-generating bundles of rays on the support surface.

DESCRIPTION OF THE PREFERRED EMBODIMENTS

The directional or orientational terms "front, rear, top, bottom, left, right" etc., as used in the following description, are used relative to the basic direction of viewing of an operator looking onto the support surface 6.

Figure 1:
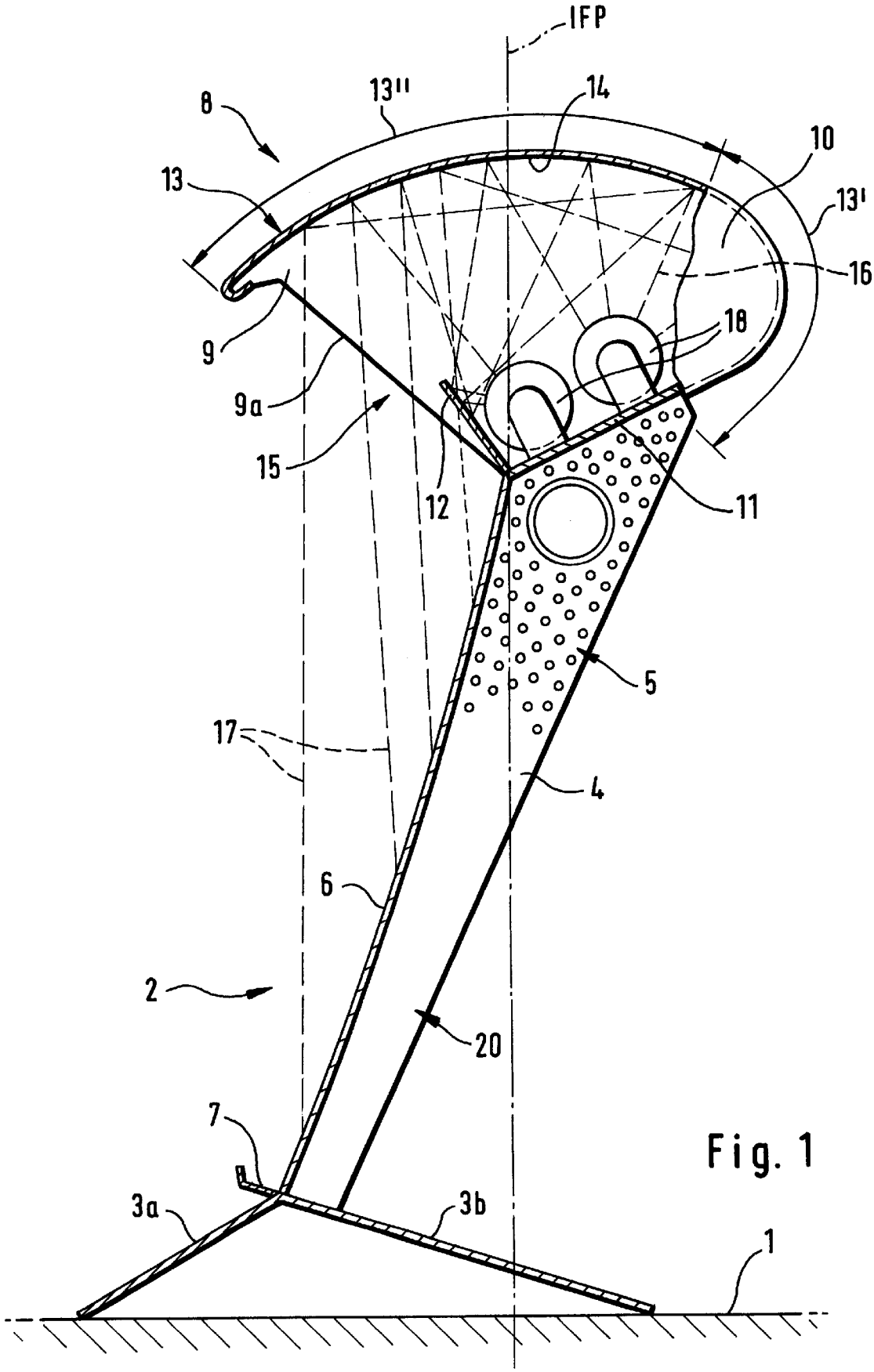
FIG. 1 is a side view from the right onto the novel illustration illuminator whose right light assembly wall is partially cut away.

FIG. 1 shows the novel illustration illuminator 2 positioned on a support surface 1. The viewer looks onto its right side. The illustration illuminator 2 has a leg arrangement comprised of the forward (3*a*) and rearward (3*b*) parts. The leg arrangement 3*a*, 3*b* supports the frame 20 which projects upwardly and at a slant and is comprised at least of lateral frame parts and a support surface 6 arranged therebetween. In FIG. 1, the right lateral frame parts 4 is illustrated which has a decorative portion 5. This decorative portion 5 can also cover the entire lateral frame part.

The forward lower edge of the support surface 6 is delimited by a stop 7 which extends preferably over the entire width and secures the illustration placed onto the support surface 6 against sliding or slipping. At the upper surface of the frame 20 the light assembly 8 is connected which is configured in the novel way according to the invention. The lower forward edge of the light assembly 8 is flush with the upper edge of the support surface 6.

The light assembly 8 is comprised of a base 11 supporting lamps 18, a light assembly cover 13 which begins at the base 11 and ends with its forward edge in a frontal plane which is positioned in front of the forward frontal plane of the support surface 6, as well as a left (9) and a right (10) light assembly wall which laterally delimit in a light-sealing way the space which is enclosed by the base 11 and the light assembly cover 13. The light assembly 8 comprises well-known operating means such as switches, cables etc. which are not illustrated in the drawing.

In order to be able to view the arrangement of the lamps 18, the light assembly wall 10 to the right is partially cut away so that the inner surface of the left light assembly wall 9 can also be seen which is delimited in a direction to the front by a forward edge 9*a*.

In the interior of the light assembly 8, in front of the lamps 18, i.e., in a direction toward the viewer, a screen plate 12 is arranged which shields the lamps 18. The lamps 18 are arranged on the base 11 such that the lamp or lamps 18 substantially is/are arranged within or behind an imaginary frontal plane IFP which is positioned behind the upper edge of the support surface 6 receiving the illustration.

The inner surface of the light assembly cover 13 is provided with a reflective layer 14. In particular, it is also provided that the light assembly cover 13 has several successively arranged and preferably seamlessly connected sections 13' and 13", wherein these sections, in particular, neighboring sections 13' and 13", have curvatures of different magnitude.

The section 13' having the greatest curvature, is arranged in an area of the light assembly cover 13 to the rear relative to the viewer, while the significantly more weakly curved light assembly cover section 13", beginning at the section 13', extends to the forward edge of the light assembly cover 13.

Preferably, the curvature of the light assembly cover 13 in this embodiment is also selected such that, based on the planar base 11, i.e., the light assembly bottom, any location on the curved sections of the light assembly cover 13 has a different radius of curvature.

Figure 2:
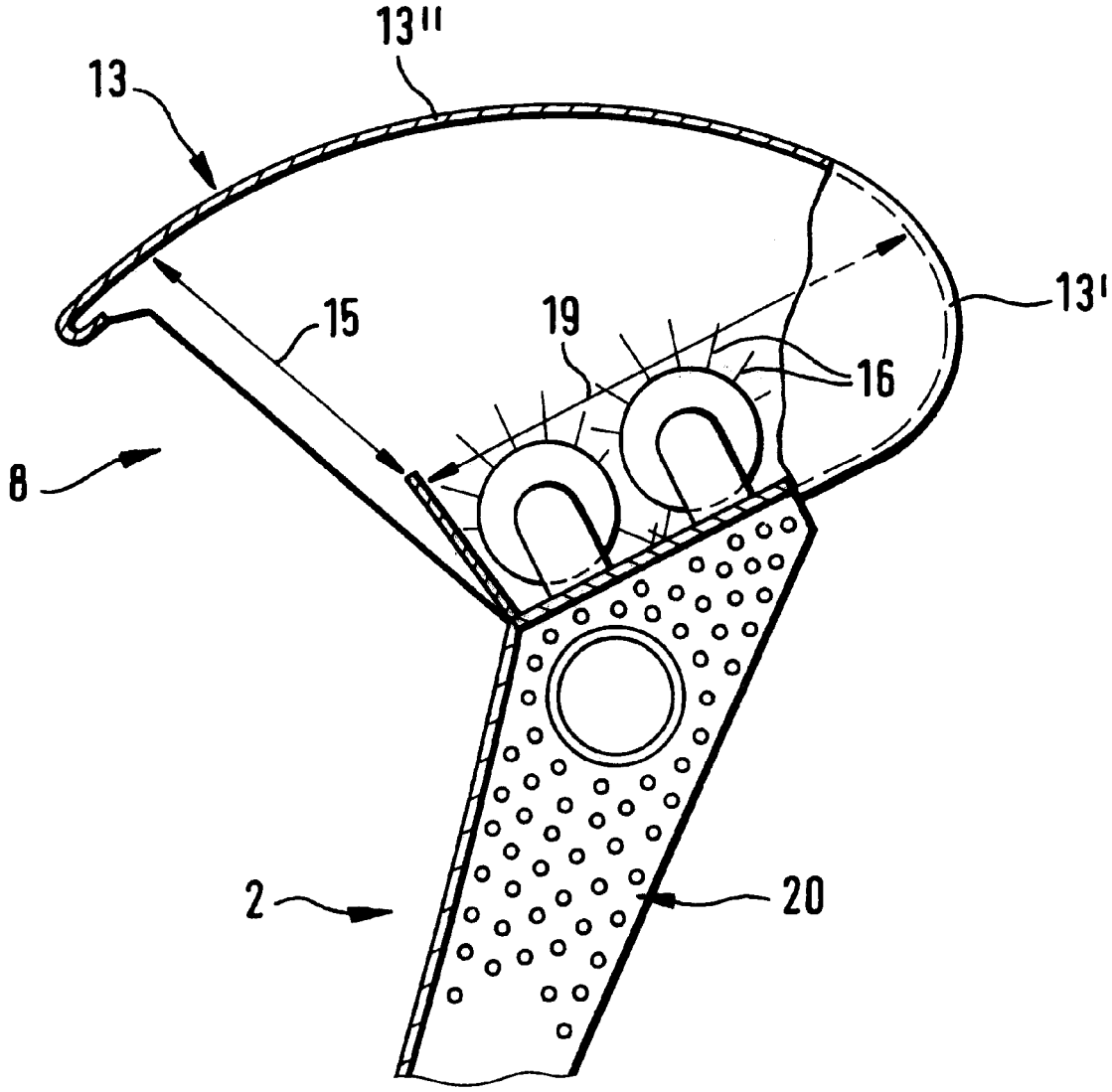
FIG. 2 is a detail of FIG. 1.

The light rays 16 emitted by the lamp or lamps 18 of the light assembly 8, which are formed to bundles of rays by an inner aperture 19 which is formed by the upper edge of the screen plate 12 and the area of the greatly curved section 13' of the light assembly cover 13 positioned at a right angle to the latter (see FIG. 2), are reflected on the respective reflection layer 14 of the sections 13' and 13" of the light assembly cover 13 at least once, preferably several times. Corresponding details are illustrated in FIG. 2 as a supplement to FIG. 1.

Only after one reflection, preferably two to five reflections, the bundles of rays exit from the light assembly 8 through an outlet or outer aperture 15 (see FIG. 2), which delimits a ray channel oriented toward the support surface 6, and impinge as directionally oriented, homogenous, indirect light-generating bundles 17 of rays on the support surface 6.

While specific embodiments of the invention have been The shown and described in detail to illustrate the inventive principles, it will be understood that the invention may be embodied otherwise without departing from such principles.

What is claimed is:

1. An illustration illuminator comprising:

a leg arrangement;

a frame connected to the leg arrangement and extending upwardly and at a slant rearwardly away from the leg arrangement;

a support surface arranged at a front side of the frame and configured to support an illustration to be illuminated;

a light assembly connected to the frame remote from the leg arrangement and configured to illuminate the support surface;

the light assembly having one or more lamps emitting light rays and further having a front end with an outlet via which the light rays exit and impinge on the support surface;

the light assembly having a reflector arranged relative to the one or more lamps such that all light rays emitted by the one or more lamps pass through the outlet only after having been reflected at least once on the reflector.

2. The illustration illuminator according to claim 1, wherein at least one of the one or more lamps is positioned in or behind an imaginary frontal plane of the light assembly located behind an upper edge of the support surface.

3. The illustration illuminator according to claim 2, wherein the light assembly comprises a base, on which the one or more lamps are mounted, and a light assembly cover having an inner surface provided with a reflective layer forming the reflector, wherein the light assembly cover extends from a rearward end of the base to the front end of the light assembly and has a forward edge located in front of the support surface.

4. The illustration illuminator according to claim 3, wherein the light assembly cover comprises several successively arranged sections, wherein the sections have different curvatures relative to one another.

5. The illustration illuminator according to claim 4, wherein the section are seamlessly connected to one another.

6. The illustration illuminator according to claim 4, wherein those sections that are adjacent to one another have different curvatures relative to one another.

7. An illustration illuminator comprising:

a leg arrangement;

a frame connected to the leg arrangement and extending upwardly and at a slant rearwardly away from the leg arrangement;

a support surface arranged at a front side of the frame and configured to support an illustration to be illuminated;

a light assembly connected to the frame remote from the leg arrangement and configured to illuminate the support surface;

the light assembly having one or more lamps emitting light rays and further having a front end with an outlet via which the light rays exit and impinge on the support surface; the light assembly having a reflector arranged relative to the one or more lamps such that the light rays emitted by the one or more lamps pass through the outlet only after having been reflected at least once on the reflector, wherein at least one of the one or more lamps is positioned in or behind an imaginary frontal plane of the light assembly located behind an upper edge of the support surface, wherein the light assembly comprises a base, on which the one or more lamps are mounted, and a light assembly cover having an inner surface provided with a reflective layer forming the reflector, wherein the light assembly cover extends from a rearward end of the base to the front end of the light assembly and has a forward edge located in front of the support surface, wherein the light assembly cover comprises several successively arranged sections, wherein the sections have different curvatures relative to one another, wherein the light assembly has a screen and an inner aperture, wherein the inner aperture is defined by an upper edge of the screen and an area of the sections of the light assembly cover having the greatest curvature, which area is positioned at a right angle to the screen.

8. The illustration illuminator according to claim 7, wherein the outlet of the light assembly is an outer aperture delimiting a light ray channel to the support surface, wherein the outer aperture is defined by the upper edge of the screen and the forward edge of the light assembly cover.

* * * * *